United States Patent [19]

Sims, Jr.

[11] 4,010,838

[45] Mar. 8, 1977

[54] SPACER BAR MECHANISM

[75] Inventor: Dewey M. Sims, Jr., Westland, Mich.

[73] Assignee: Burroughs Corporation, Detroit, Mich.

[22] Filed: Jan. 17, 1975

[21] Appl. No.: 541,790

[52] U.S. Cl. ..... 197/98; 16/172; 340/365 R

[51] Int. Cl.[2] ..... B41J 5/08

[58] Field of Search ..... 197/82, 84 R, 84 A, 197/98, 84 B; 308/1 R, 4 R, 36, 74, 75, 44, 45; 403/26, 119; 16/171, 172; 340/365 R; 235/145, 146

[56] References Cited

UNITED STATES PATENTS

| | | | |
|---|---|---|---|
| 399,964 | 3/1889 | Benet | 16/171 |
| 2,618,809 | 11/1952 | Rubinoff | 16/172 |
| 2,637,460 | 5/1953 | Yates | 16/172 X |
| 3,091,357 | 5/1963 | Weinhart | 16/172 X |
| 3,292,761 | 12/1966 | Erpel | 197/98 X |
| 3,338,369 | 8/1967 | Rexford | 197/98 X |
| 3,711,685 | 1/1973 | Castle | 197/98 X |
| 3,720,801 | 3/1973 | Yanaga | 197/98 X |
| 3,771,636 | 11/1973 | Kerns | 197/82 |

*Primary Examiner*—Ralph T. Rader
*Attorney, Agent, or Firm*—Robert C. J. Tuttle; Ronald L. Taylor; Carl Fissell, Jr.

[57] ABSTRACT

An electronic keyboard is provided with a centrally operable elongated spacer bar that affords a smooth response to depression anywhere along its linear spans, a bail preloadably anchored at various points along the keyboard base being pivotally coupled to the extremities of the spacer bar to effectuate an even load distribution and minimal central drag upon each spacer bar depression, the preloadable anchoring of the bail at the various points along the keyboard base permitting convenient assembly of the spacer bar on the keyboard without the use of tools.

8 Claims, 3 Drawing Figures

SPACER BAR MECHANISM

BACKGROUND OF THE INVENTION

Field of the Invention

This invention relates to keyboards in general and particularly to spacer bars forming a part of such keyboards.

Prior Art

In mechanical keyboards for typewriters and serial printers, conventional spacing or tabulating bars have generally involved complicated mechanical linkages that must be activated during each spacer bar depression, the added load of such linkages rendering the spacer bar more resistive to depression than the alpha and numeric keys of the keyboard, and thereby tending to disrupt the natural rhythm of the keyboard operator. With the advent of electric or electronic keyboards in typewriters and serial printers, the resistance to spacer bar depression was significantly reduced, it being the function of such depression merely to switchably activate appropriate circuitry to accomplish the required spacing or tabulation, and the activation of any mechanical linkages that might be employed being accomplished by power conveyed by the circuitry.

Characteristic of the spacer bars that have been used in electronic keyboards for typewriters and serial printers is their elongated configuration, their placement relative to the plurality of alpha and numeric keys, and their manner of making switchable contact with the electrical circuitry, their placement and elongated configuration being designed to provide convenient access to the operator and to facilitate a smooth and rhythmical hand movement relative to the overall area of the keyboard. While being of elongated configuration, known spacer bars on electronic keyboards have generally been operable to effectuate switchable contact at a single central point, depression of the spacer bar at any point along its linear spans being effective to activate a switch disposed underneath the spacer bar and intermediate its extremities. With spacer bars of the type described, variable responses to depression have been encountered, depending upon the particular areas thereof that are manually contacted, depression of a bar at its central area resulting in an optimized response and depression in the areas of its extremities resulting in a slightly delayed response caused by tilting or binding in the area of the spacer bars central stem. Although these variations in responses to depression may be slight, they have been found to interrupt the natural rhythm that would otherwise be attainable by a keyboard operator, and thus to prevent maximized speed in the manipulation of the electronic keyboard.

Summary of the Invention

Accordingly, it is an important object of the present invention to provide a spacer bar assembly for use on electronic keyboards and wherein means are provided for equalizing the variable responses to depression that have heretofore been encountered, and wherein an equal response may be realized regardless of the particular area along the spacer bar that is depressibly contacted.

It is another important object of the present invention to provide a spacer bar assembly that may be conveniently installed on an electronic keyboard and wherein such installation may be accomplished without the use of tools.

It is still another object of the present invention to provide a spacer bar mechanism with response equalizing means and wherein such means is not susceptible to noise and vibration nor the elements thereof likely to become loosened or displaced during the normal operation of the associated typewriter or printer.

An important aspect of the invention is the provision of a centrally operable elongated spacer bar that is pivotally coupled at its outer extremities to the extremities of a pivotable wire-like bail that is anchored to a base member of the keyboard matrix, depression of the spacer bar on a side thereof remote from its central operating point resulting in a bail assisted friction free lowering of the spacer bar as the pivoting force of the bail is transmitted from the force receiving side and applied to the extremity of the bar opposite the side thereof to which the depressing force was applied.

Another important aspect of the invention is the elastically bendingly anchoring of the pivotal wire-like bail to the base member of the keyboard matrix, and the manner of coupling the extremities of the bail to the extremities of the spacer bar, such anchoring and coupling permitting convenient installation of the bail and spacer bar on the keyboard matrix without the use of tools.

BRIEF DESCRIPTION OF THE DRAWING

These and other objects, aspects and advantages of the inventive spacer bar assembly will become more readily apparent in light of the following description when read in conjunction with the following drawing figures, in which.

DESCRIPTION OF THE PREFERRED EMBODIMENT

Figures 1, 2, 3:
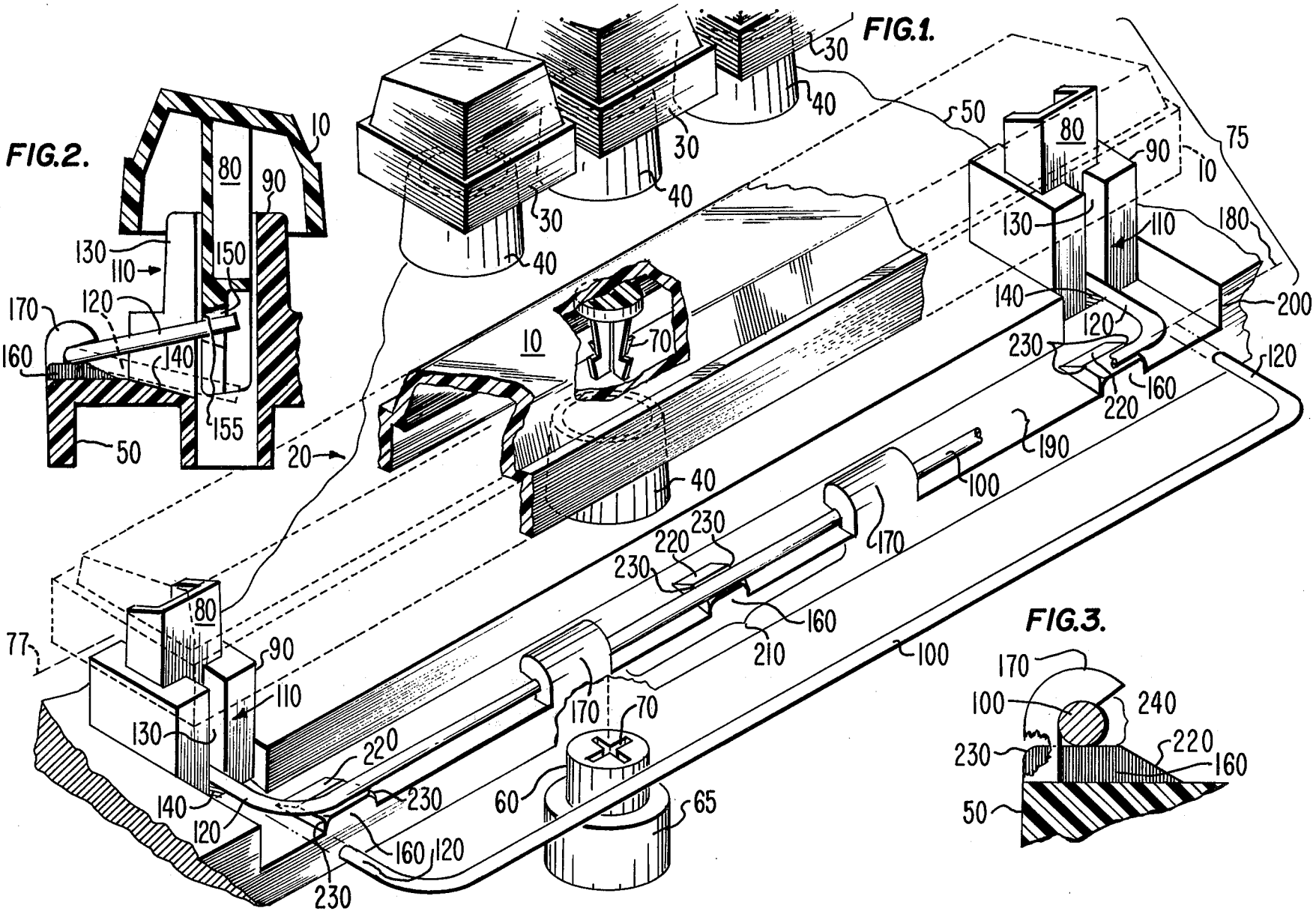
FIG. 1 is a perspective view of the inventive spacer bar assembly mounted on the base of an electronic keyboard.
FIG. 2 is a side elevational view of the mounted assembly of FIG. 1 showing the relationship of various of its interconnecting members.
FIG. 3 is a fragmentary view of various of the elements illustrated in FIG. 2 and showing in greater detail various aspects of the spacer bars mounting on the keyboard base.

In the preferred embodiment of the invention as shown in FIG. 1, an elongated spacer bar 10 is assembled on a typical electronic keyboard matrix 20 with a plurality of alpha and/or numeric keys 30 disposed adjacent and to the rear of the spacer bar 10. Conventional electronic keyboards of this type are commonly employed as data inputs to data processing systems and for typing or printing data by means of data processing peripherals. The spacer bar 10 and each of the plurality of alpha-numeric keys 30 are mounted for depressible activation relative to circular raised portions 40 that are integrally formed with the keyboard matrix 20, a spring mounted stem or actuating shaft 60 of the spacer bar or key being lowered upon depression to actuate associated electronic switches 65 and to thereby input the represented data or to perform a selected output function such as the tabulation of a serial printing head relative to journal paper upon which output data is to be printed. Each of the stems or actuating shafts 60 is slidably mounted and vertically disposed relative to its circular raised portion 40, and upon depression of the spacer bar 10 or a key 30 the associated stem or actuating shaft 60 will operate to close its associated keyboard switch 65. The stems or actuating shafts 60 may be comprised of bifurcated friction couplings 70 that are fixed to the caps of the keys, such bifurcated couplings being snappably received within correspondingly formed apertures in the stems or shafts as more particularly described in U.S. Pat. No. 3,856,998 which issued on Dec. 24, 1974 to the applicant of the present application.

The spacer bar 10 as shown in FIG. 1 is an elongated key top suitable for manual depression anywhere along its axis 77. In addition to being constrained for reciprocal vertical movement by the cooperation of its associated activating shaft 60 and circular raised portion 40, the spacer bar 10 is additionally constrained for reciprocal vertical motion relative to the keyboard matrix 20 by the cooperation of a pair of channel-shaped members 80 fixed to the underside of the spacer bar 10, and a pair of hollowed posts 90 forming a part of a base member 50, as best illustrated in FIG. 2. The hollowed posts 90 serve to slidably guide the channel-shaped members 80 of the spacer bar 10 upon each spacer bar depression. The posts 90, channel-shaped members 80 and the spacer bar 10 may be composed of plastic-like material for low noise generation and transmission.

The spacer bar 10 of the present invention forms a part of an assembly 75 that also includes a wire-like bail 100 disposed in parallel relationship to the axis 77 and pivotally anchored to the base of the keyboard matrix, as best illustrated in FIG. 1. the bail 100 is comprised of a pair of offset extremities or legs 120 that are coupled to the channel-shaped members 80 as generally indicated at 110 in FIG. 2. As also illustrated in FIGS. 1 and 2 each of the posts 90 is provided with a vertical slot 130 by means of which the coupling of the legs 120 and channel-shaped members 80 is accommodated. The coupling of the bail 100 with the members 80 is accomplished by the insertion of the ends of the legs 120 into cone-shaped apertures 150 formed in the members 80, as best illustrated in FIG. 2. It will also be noted from FIG. 2 that the floor 140 of each of the slots 130 is sloped downwardly to thereby provide a deeper arc of travel of the bail and legs 120 upon depression of the spacer bar 10. The cone-shaped aperture 150 formed in each of the channel-shaped members 80 provides a small diameter 155 that is but slightly larger than the diameter of the bail 100 and legs 120. It can thus be seen that the cone-shaped apertures 150 are designed to permit ready insertion of the legs 120, while at the same time permitting the legs 120 to arcuately follow the vertical reciprocating motion of the members 80 upon activation of the spacer bar 10.

The wire-like bail 100 is elastically bendingly anchored to the base member 50 of the keyboard matrix by a plurality of bottom projections or land areas 160 and a plurality of top projections or overhang areas 170, such land and overhang areas defining an axis 180 of pivotal rotation for the bail 100. A well-like depression 190 adjacent a forward edge 200 of the base member 50 may be provided to accommodate the land areas 160 and overhang areas 170. This depression 190 will serve to limit the frictional drag on the bail 100 to the land areas 160 and overhang areas 170, and, particularly that portion 210 of the depression 190 will serve to facilitate the application of tactile pressure on the bail 100 during the installation of the bail 100 and spacer bar 10 on the keyboard matrix, as hereinafter described. The land areas 160 serve to constrain the bail 100 from underneath, as shown in FIG. 3, and guide slopes 220 thereof serve to facilitate the snap-in engagement of the bail during assembly of the bail 100 and spacer bar 10. The top edges 230 of the land areas 160 should be de-burred such that the bail 100 will be uniformly constrained by a substantial portion of the land areas and such that the bail 100 is prevented from buckling on a sharp edge on the land areas. It will be observed from FIG. 1 that three land areas 160 are provided in the preferred embodiment of the invention.

The overhang areas 170 serve to constrain the bail 100 from above and are so arranged as to encompass approximately 180° of the bails circumference, as best illustrated in FIG. 3, the overhang areas 170 and land areas 160 together substantially defining an inner diameter slightly less than the outer diameter of the bail 100. Each of the overhang areas 170 is provided with an entrance way 240 by means of which the bail 100 may be snapped into place between the overhang areas 170 and the land areas 160, the legs 120 thereof having first been inserted into the cone-shaped apertures 150 formed in the channel-shaped members 80 and the elongated portion of the bail 100 placed upon the guide slopes 220 of the land areas 160. With the legs 120 inserted into the apertures 150 and the bail 100 resting on the guide slopes 220, manual pressure applied to the bail 100 intermediate the overhang areas 170 will result in the yieldable reception of the bail 100 between the land areas 160 and overhang areas 170. It will be observed from FIG. 1 that two overhang areas 170 are provided in the preferred embodiment.

Once the bail 100 is constrained to its predetermined axis 180, it may be noted that the projections 160 and 170 serve to apply a slight preloading stress on the flexible metal of the bail 100, the land areas 160 having an up-pushing effect on the bail and the overhang areas 170 having a down-pushing effect, such effects in combination providing the bail 100 with a slight undulation along its axis 180. The effect of this undulation in the bail 100 is called into play whenever the spacer bar 10 is depressed at any point other than at its central operating point corresponding to the stem or actuating shaft 60. Such off-center depression of the spacer bar 10 would, in the absence of the assisting bail 100, require greater manual pressure to actuate the switch 65 than would depression of the spacer bar 10 in the vicinity of its central operating point, the degree of pressure required increasing at a rate proportional to the distance removed from the central operating point. With the provision of the elastically bendingly anchored bail 100, and by reason of the undulation provided it by the land areas 160 and overhang areas 170, an off-center depression of the spacer bar 10 will result in the rotational translation of the depressing force along the axis 180 from the depressed leg 120 to the opposite leg 120, the latter leg 120 thereby serving to lower the extremity of the spacer bar 10 opposite the extremity that received the initial depressing force. The effect of this force translation will be to maintain the spacer bar 10 in a level state regardless of the area depressed, and to thereby eliminate all frictional binding at both the central operating point and at the areas defined by the hollowed posts 90. It is important to note that since the bail 100 is stressed in its normal position, depression of the spacer bar 10 will further stress the bail 100 to thereby produce the effect of a torsion spring, the undepressed leg 120 tending to follow the depressed leg 120 in a substantially instantaneous manner and without any appreciable time lag, the two legs of the bail 100 tending to remain in a common plane to thereby provide a uniform response to spacer bar depression regardless of the area thereof that initially receives the depressing force. It will be realized that in addition to the advantages herein ascribed to the bail 100, the preloaded bail 100 will also aid in the spring-actuated return of the spacer bar 10 to its normal elevated position, such assistance being realized also by reason of the tendency of the bail 100 to seek a lower stress level and to remain in a level state. Additionally a beneficial side effect may be realized by forming the land areas 160 and overhang areas 160 of a plastic-like material such that a bell-clapper effect between the bail 100 and the projections may be avoided.

Although a preferred embodiment of the inventive spacer bar mechanism has been described in considerable detail, it will be apparent that various changes and modifications therein may be made by those skilled in the art without departing from the true spirit and scope of the invention.

What is claimed is:

1. A spacer bar assembly for an electronic keyboard having a base member and a plurality of actuatable keys, said assembly comprising:

a. an elongated spacer bar, b. an electronic switch operatively positioned underneath said spacer bar, c. a spring loaded actuating shaft centrally fixed to the underside of said spacer bar and disposed in actuating relationship with said electronic switch, the spring loading of said shaft being effective for yieldably supporting said spacer bar in a raised inoperative position relative to said switch, d. a U-shaped wire bail having a linear central portion pivotally anchored to said base member and a pair of offset leg extremities operatively coupled to the extremities of said spacer bar, and e. wire engaging means formed in said base member for pivotally anchoring said linear central portion of said U-shaped bail and further for applying a constant undulating stress thereto, said wire engaging means including land and overhang projections alternately disposed along the pivotal axis of said central linear portion of said U-shaped bail, each of said land projections being provided with a guide slope and each of said overhang projections being provided with a yieldably restrictive opening, said guide slopes and said yieldably restrictive openings serving to facilitate and to accommodate the installation of said central linear portion of said U-shaped bail between said land and overhang projections upon the application of tactile pressure to said central linear portion of said bail.

2. The spacer bar assembly defined in claim 1 wherein three land projections and two overhang projections are formed in said base member, an outermost pair of said three land projections defining the length of said central linear portion of said bail and a third of said land projections being disposed midway between said outermost pair, said two overhang projections being disposed substantially intermediate adjacent pairs of said three land projections.

3. The spacer bar assembly as defined in claim 1, wherein said land and overhang projections are formed in said base member in a well-like depression adjacently disposed relative to an edge of said keyboard and parallelly disposed relative to said linear central portion of said U-shaped bail.

4. A spacer bar assembly for an electronic keyboard having a base member and a plurality of actuatable keys, said assembly comprising:

a. an elongated spacer bar, b. an electronic switch operatively positioned underneath said spacer bar, c. a spring loaded actuating shaft centrally fixed to the underside of said spacer bar and disposed in actuating relationship with said electronic switch, the spring loading of said shaft being effective for yieldably supporting said spacer bar in a raised inoperative position relative to said switch, d. a U-shaped wire bail having a linear central portion pivotally anchored to said base member and a pair of offset leg extremities operatively coupled to the extremities of said spacer bar, the operative coupling of the offset leg extremities to the extremities of the spacer bar being effected by means of, i. a pair of vertically disposed hollow posts upstanding from said base member, each of said hollow posts being provided with a vertically disposed slot having a downwardly sloping floor portion, ii. a pair of channel-shaped members fixed to the underside of said spacer bar proximate the outer extremities thereof, said channel members being received within and guided for reciprocal movement relative to said pair of hollow posts, and iii. a cone-shaped aperture formed in each of said pair of channel-shaped members and in aligned relationship with said vertically disposed slots formed in said hollow posts, said pair of offset leg extremities of said U-shaped bail transversely communicating with said vertical slots of said hollow posts and being received within said cone-shaped apertures formed in said channel-shaped members, and e. wire engaging means formed in said base member for pivotally anchoring and constraining said wire member and further for applying a constant undulating force in the linear central section thereof, said wire engaging means being defined to include land and overhang projections that combine to constrain said U-shaped wire bail and impart the constant undulating force to the linear central section.

5. In an electronic keyboard having a plurality of switches disposed in a base portion thereof, and having also an elongated spacer bar and a plurality of keys disposed for reciprocal movement relative to selected ones of said switches, said spacer bar generally being variably responsive to depressive actuation at different points along its linear span, improved means for compensating for off-center depressions of said spacer bar and for rendering the response of said spacer bar consistently uniform and uniform also to the response to said plurality of keys, said improved means comprising:

a. a U-shaped bail having a linear central section pivotally anchored to said base portion of said keyboard and a pair of offset leg extremities operatively coupled to the extremities of said elongated spacer bar, and b. bail engaging means formed in said base portion for pivotally anchoring said linear central portion of said U-shaped bail and further for applying a constant undulating stress thereto, said bail engaging means including land and overhang projections alternately disposed along the pivotal axis of said central linear portion of said U-shaped bail, each of said land projections being provided with a guide slope and each of said overhang projections being provided with a yieldably restrictive opening, said guide slopes and said yieldably restrictive openings serving to facilitate and to accommodate the installation of said central linear portion of said U-shaped bail between said land and overhang projections upon the application of tactile pressure to said central linear portion of said bail.

6. The improved means defined in claim 5, wherein three land projections and two overhang projections are formed in said base portion of said keyboard, an outermost pair of said three land projections defining the length of said central linear portion of said bail and a third of said land projections being disposed midway between said outermost pair, said two overhang projections being disposed substantially intermediate adjacent pairs of said three land projections.

7. The improved means defined in claim 5, wherein said land and overhang projections are formed in said base portion in a well-like depression adjacently disposed relative to an edge of said keyboard and parallelly disposed relative to said linear central portion of said U-shaped bail.

8. In an electronic keyboard having a plurality of switches disposed in a base portion thereof, and also having an elongated spacer bar and a plurality of keys disposed for reciprocal movement relative to selected ones of said switches, said spacer bar generally being variably responsive to depressive actuation at different points along its linear span, improved means for compensating for off-center depressions of said spacer bar and for rendering the response of said spacer bar consistently uniform and uniform also to the response of said plurality of keys, said improved means comprising:

a. a U-shaped bail having a linear central section pivotally anchored to said base portion of said keyboard and a pair of offset leg extremities operatively coupled to the extremities of said elongated spacer bar, the operative coupling of the offset leg extremities to the extremities of the spacer bar being effected by means of, i. a pair of vertically disposed hollow posts upstanding from said base member, each of said hollow posts being provided with a vertically disposed slot having a downwardly sloping floor portion, ii. a pair of channel-shaped members fixed to the underside of said spacer bar proximate the outer extremities thereof, said channel members being received within and guided for reciprocal movement relative to said pair of hollow posts, and iii. a cone-shaped aperture formed in each of said pair of channel-shaped members and in aligned relationship with said vertically disposed slots formed in said hollow posts, said pair of offset leg extremities of said U-shaped bail transversely communicating with said vertical slots of said hollow posts and being received within said cone-shaped apertures formed in said channel-shaped members, and b. wire engaging means formed in said base member for pivotally anchoring and constraining said wire member and further for applying a constant undulating force to the linear central section thereof, said wire engaging means being defined to include land and overhang projections that combine to constrain said U-shaped wire bail and to impart the constant undulating force to the linear central section.

* * * * *